United States Patent [19]

Fishman et al.

[11] Patent Number: 4,833,040

[45] Date of Patent: May 23, 1989

[54] OXIDATION RESISTANT FINE METAL POWDER

[75] Inventors: Erwin Fishman, Hermosa Beach; Morton L. Kraft, LaPalma; William B. Coleman, Redondo Beach, all of Calif.

[73] Assignee: TRW Inc., Redondo Beach, Calif.

[21] Appl. No.: 39,889

[22] Filed: Apr. 20, 1987

[51] Int. Cl.[4] ..... B22F 9/00

[52] U.S. Cl. ..... 428/570; 252/513

[58] Field of Search ..... 428/570; 252/513

[56] References Cited

U.S. PATENT DOCUMENTS

| | | | |
|---|---|---|---|
| 1,986,197 | 1/1935 | Harshaw | 428/570 |
| 2,646,456 | 7/1953 | Jacquier | 428/570 |
| 2,933,415 | 4/1960 | Homer et al. | 428/570 |
| 3,045,334 | 7/1962 | Berzins | 428/570 |
| 3,428,442 | 2/1969 | Yurasko, Jr. | 428/570 |
| 3,479,181 | 11/1969 | Backstrom et al. | 428/570 |
| 3,663,241 | 5/1972 | Short | 428/570 |
| 3,718,594 | 2/1973 | Miller | 428/570 |
| 3,838,982 | 10/1974 | Sanderow et al. | 428/570 |
| 3,843,593 | 10/1974 | Shell et al. | 524/424 |
| 4,349,421 | 9/1982 | Khattab | 204/38.4 |
| 4,397,812 | 8/1983 | Mallory, Jr. | 420/441 |
| 4,453,976 | 6/1984 | Smythe | 420/543 |
| 4,455,167 | 6/1984 | Osborn | 75/255 |

FOREIGN PATENT DOCUMENTS

| | | | |
|---|---|---|---|
| 784148 | 4/1963 | Canada . | |
| 2843795 | 4/1979 | Fed. Rep. of Germany | 428/570 |
| 0008352 | 1/1978 | Japan | 428/570 |
| 0062908 | 5/1981 | Japan | 428/570 |
| 1079706 | 4/1986 | Japan | 428/570 |
| 1079707 | 4/1986 | Japan | 428/570 |
| 2020476 | 11/1979 | United Kingdom . | |

OTHER PUBLICATIONS

C. A. Loto, "Electroless Nickel Plating of Iron Powders", *Journal of Metals,* Aug. 1987.

"Metal Powders", Sherritt Gordon Mines Limited, Jan. 1960.

Kirk-Othmer, Encyclopedia of Chemical Technology, 3rd Edition, John Wiley & Sons, New York, N.Y. (1982), vol. 19, pp. 28-62.

Kirk-Othmer, Encyclopedia of Chemical Technology, 3rd Edition, John Wiley & Sons, New York, N.Y. (1979), vol. 8, pp. 826-869.

*Primary Examiner*—John P. Sheehan

*Assistant Examiner*—David W. Schumaker

*Attorney, Agent, or Firm*—Jeffrey G. Sheldon

[57] ABSTRACT

A fine iron powder, being a carbonyl iron powder is electrolessly plated with an oxidatively resistant metallic coating. The coating is obtained from a bath containing nickel and copper salts. Oxidation resistance is improved at temperatures greater than 100° C. Products containing these fine powders include liquids to provide increased oxidation resistance for coating a substrate, and articles formed by such powdered metals with or without other materials, such as ceramic or refractory materials.

18 Claims, No Drawings

OXIDATION RESISTANT FINE METAL POWDER

BACKGROUND

This invention relates to fine powders, particularly fine powder comprising iron particles. In particular the invention is concerned with carbonyl iron which is rendered oxidatively resistant.

Powdered iron is used in a wide variety of applications. In powder metallurgy, such powder can be used to form a multitude of materials and shaped objects. The bonding of powdered particles into a mass of metal powder by molecular or atomic attraction into the solid state is effected by heating below the melting point of the metal. Sintering of the powder mass normally results in densification and often recrystalization.

Powders can be mixed in different forms and flowed into die cavities, and there formed into useful products under pressure or die molding. Heating is appropriately applied to obtain suitable product characteristics. Supplementary operations can be effected such as rolling or drawing thereby to obtain suitable machined products which can then be subjected to other finishing operations.

Resultant powdered metallic products have a metallic shape equivalent in function, although of lower density, and often of equivalent physical and mechanical properties to a wrought metal product. Such powdered metal products are produced faster, and normally at lower costs in terms of labor, material and energy.

A characteristic of different powdered metals is that the shape can vary from regular uniform spheroids to irregular spheroids, irregular spongy structures, dendritic, angular, flakey or leaf-like structures.

The particle size can vary from an average of about 2 microns to 80 microns. The method of fabricating the powder normally determines the size. Thus a carbonyl iron powder made by a carbonyl decomposition process produces fine particle size in a range of 1 to 20 microns, with a mean diameter of about 10 microns. An electrolytic process produces the average particle size of about 80 microns.

Different manufacturing processes produce different shapes. Thus the carbonyl process produces a substantially uniform spheroid particle shape, the atomization process produces round irregular spheroids and the electrolytic process produces a dendritic shape.

This invention is particularly concerned with carbonyl particles, namely those made by the decomposition of liquid or gaseous metal carbonyl (iron or nickel) to give a highly purified fine powder. This process is effected by applying heat to a composition of $Fe(CO)_5$ which then decomposes to iron particles and carbon monoxide.

When different powders are combined superalloys are obtained which can produce products with high melting points, composite metals, metal-non-metal combinations, porous metals, metals of extremely high purity, wear surface-coatings, and decorative-coatings such as gold or silver for use, for instance, in the graphic arts.

The multitude of applications of powdered metal parts often depends on the nature of the powdered metal. Components made from porous powdered metal include self-lubricating bearings, bushings and metallic filters and other structural entities and shapes. Products are for use with gas and liquids, and can be used for instance, in metering devices, distribution manifolds and storage reservoirs. Powdered metallic structures can be created by spraying metal onto a substrate.

Powdered metal tool steels include drills, knife blades, cutters, insert blades for gear cutters, and cutting and cutting tool inserts.

Powdered metal friction materials can be metal-non-metal combination. Such materials form clutch plates, brake pads and blocks and packing compositions. A sintered friction material can be composed of a metal matrix which includes copper and metal such as tin, zinc, lead and iron together with graphite and friction producing components such as silica or asbestos.

Powdered metallurgical electrical products constitute electrical contact elements such as tungsten contacts which are used for automotive and appliance applications. Often the use is limited because of an insulating oxide which forms during switching.

Copper and silver are combined with refractory materials such as tungsten, tungsten carbide and molybdenum in applications for power circuit-breakers and transformers, and tap-changers where they are confined to an oil bath because of the rapid oxidation in air. Where the contact is made of tungsten-silver, operation in air is possible because of the silver. Costs, however, are increased.

Powdered metal products also constitute permanent magnets and soft magnetic parts such as iron pole pieces for small DC motors and generators, cores for generators and radio transformers and measuring instruments. An iron powdered core for this purpose is coated with an electrically insulated material, compacted, ejected and baked to fuse the coated particles together. Such cores afford a large change of inductance by movement in one direction in or out of a wire wound-coil. Fine iron powder usually of electrolytic or carbonyl type is employed. Such cores exhibit minimum eddy current and hysteresis losses and the magnetic permeability returns to its original value after application of large magnetizing forces.

Other applications in this field include those of elements for incandescent lamps, electronic tubes and resistor elements. Refractory metals can be used to produce filament wire for incandescent lamps.

Additionally, powdered heavy metal compositions have important uses in electronics, alloying, nuclear power, chemical catalysts, metal cutting and forming, mining and drilling.

Cemented carbides containing tungsten carbide imbedded in a matrix of cobalt are used for parts requiring corrosion resistant. These include burnishing tools and dies, pump valves, nozzles, guages and drills.

High temperature applications are achieved with cermets which are metal ceramic combination. Cermets provide characteristics between cobalt/nickel base super alloys and refractory materials such as tungsten. Such mixtures have the high temperature strength of ceramics and sufficient ductility and thermocondutivity to provide resistance from thermo-shock at high temperatures and also workability at room temperatures. Composite materials can be formed with powder imbedded in elastomeric or ceramic binders.

One of the finishing treatments which can be applied to powdered metal products is plating. In general all types of plating processes, materials and products can be used, including copper, nickel, chromium, cadmium, and zinc. The plating is effected on a finished product. Entrapment of plating solutions in the pores of the product is avoided by sealing parts with resin impregnation.

Although plating of a finished structural product has been effected in the finishing process, it has not been applied to particles while in the powdered state. Indeed, as indicated, resin impregnation is employed to prevent the plating compositions and plating effects from penetrating the surface of the structural product.

Different plating processes are well known, and range from electroplating to electroless plating. The process of plating is the deposition of an adherent metallic coating on a substrate. Whereas electroplating requires an electric current, electroless plating uses an immersion process to effect the coating. By the plating process there is imparted to the substrate an improved corrosion resistance, appearance, frictional characteristic, wear resistance and hardness to the treated surface.

In engineering applications electroplates may be applied for improved mechanical, physical, and chemical properties. Nickel improves hardness, strength, and stress together with providing generally good resistance to corrosive chemicals.

The properties of the plating treatment vary according to whether electroplating or electroless plating is applied, and additionally the nature of the material which is being plating to the substrate.

The substrate being prepared for plating is usually cleaned mechanically and chemically and thereafter rinsed and possibly acid dipped. Depending on the material being plated and its intended use, different techniques of plating are applied and different metals can be plated onto the substrate. These would include nickel, copper, cobalt, gold and lead. Nickel and copper have particular advantages and are extensively used in a thickness from a mere flash to many millimeters. Alloy plating with nickel base materials is of particular interest in regard to magnetic properties, particularly in computer technology and where electroforming is required.

Electroless plating techniques and immersion procedures provide for deposits of limited thickness relative to electroplating techniques. This process achieves uniform plating at low capital cost since no DC power is required. Autocatalytic plating employs the deposition of a metallic coat by a controlled chemical reduction that is catalyzed by the metal or alloy being deposited.

The more widely used electroless process is the electroless nickel process wherein nickel ions in solution are reduced to the metal by a reductant. The deposits usually provide good chemical and physical properties even though the initial cost may be high since a reducing agent such as sodium hypophosphite is required as well as precise control of the process.

In these cases usually a nickel/phosphorous alloy containing about 5% to 15% phosphorous is employed in a plating bath. Where electroless copper is used as a plating bath to provide products for the electrical industry, a reducing agent such as formaldehyde is used in a bath containing copper sulfate.

The applications of plated products include cases where oxidation protection and other special surface properties must be improved. Where the plating is for protection, for instance, of steel as a structural metal, paints and organic coatings containing zinc and cadmium electroplates which protect the steel substrate are widely used.

From the perspective of the plating industry also, while it has been common to plate a substrate of substantial mass it is unknown, and indeed has not been desirous to plate powdered metal particles themselves.

For many and various applications it has been found that a need exists to improve the resistance to oxidation of products employing powdered iron or being formed of powdered iron particles, particularly at higher temperatures. Despite the multitude of products and procedures which are available in the powdered metallurgy field and plating and extensive plating technology such a suitable oxidatively resistant product does not exist.

Other uses of powdered metal products are disclosed in the information disclosure statement filed contemporaneously with this application and incorporated by reference herein. None of the art disclosed there discloses powdered metal products having the appropriate oxidation resistance, particularly at elevated temperatures.

SUMMARY

The present invention fulfills the need of providing a powdered oxidatively resistant metal product, articles made from that product, and a method for providing such product.

It is an object of the present invention to provide a fine powder comprising particles of a metal, preferably at least partly iron, which are oxidatively resistant. Where iron is used the powder may be ferrite or iron powder.

According to the invention a fine powder of carbonyl iron is plated with an oxidatively resistant metallic coating, such as nickel or copper thereby to enhance the resistance to oxidation while retaining the integrity of the particles.

With particles so plated, resistance to oxidation at temperatures greater than 100° C., preferably greater than 200° C. or 400° C., and up to 800° C. is substantially enhanced.

Liquid containing these fine powdered plated particles, and substrates made of such fine powdered particles with or without elastromeric or ceramic binders provide products with enhanced resistance to oxidation for a multitude of applications in the field of powdered metallurgy. The coating material is preferably selected such that the electromagnetic properties of carbonyl are substantially retained. Many uses for such oxidatively resistant products exist as indicated in the background.

In the preferred form of the invention, the plating procedure is electroless, and is either immersion or autocatalytic plating. The powdered particles are substantially uniform spheroid structures having a diameter between about 1 micron and about 10 microns and being of an average of about 5 microns. The thickness coating plated on the particles can depend on the intended application of the powdered metal, and is preferably between about 0.1 and 0.7 microns thickness, with an average of about 0.3 microns.

In some other preferred forms of the invention, powdered particles other than iron are plated to achieve the increased resistance to oxidation. Thus the metal can be in the Group VIII transition metals. As such, nickel or cobalt particles can be plated with the metal coating.

DESCRIPTION

A fine powder is provided wherein the particles are at least partly of carbonyl iron and plated with a metallic coating to enhance the oxidative resistance of the fine particles.

A thin nickel or nickel alloy coating is provided to the particles of iron powder which have a diameter in a range between about 1 and 10 microns, preferably between about 3 to 7 microns, namely average of about 5 microns. The particle size is measured by a Micromerigraph, a product of the Del Angelo Company, Pa. or by the process of Scanning Electron Microscopy.

The plating is effected in an electroless plating bath until the coating thickness is in the range between about 0.1 to 0.7 microns, preferably about 0.2 to 0.4 microns, namely an average of about 0.3 microns.

Prior to alloy deposition the iron particles are cleaned in an acidic "activator" solution which removes oxides, scale, and other foreign material from the surface. An activator is a water-based acid solution that activates the substrate material prior to plating. After rinsing the activated solution from the powder, the iron particles are plated in an electroless nickel alloy plating bath which contains complexed nickel and copper salts and hypophosphite as a reducing agent. Complexing agents commonly used in this type of bath include lactates, succinate, and glutonates.

An effective electroless plating bath is that known as Niculoy 22 (Trademark) marketed by Shipley. This product deposits an alloy of nickel, copper and phosphorous onto a metallic and nonconductive substrate and provides an effective combination of brightness, corrosion resistance, ductility, hardness and acid resistance while being substantially non-magnetic. The corrosion resistance or oxidative resistance has been found to be extremely high.

Upon addition of iron powder to the plating bath, nickel and copper are catalytically reduced on the surface of each particle forming an adherent oxidatively protective coating. Phosphorous, donated by the reducing agent is also a constituent of this protective coating.

When plating is completed the coated powder is removed from the solution using an electromagnet. The powder is washed with deionized water and dried at 105° C.. The dried powder is classified with a 200 mesh sieve.

The carbonyl iron powder used in this embodiment is obtained from GAF Corporation and is Grade E which has the technical specification of being uniform dry grey. The apparent density is 2.2 to 3.2 grams/cm$^3$ and actual density of 3.7–4.7 grams/cm$^3$ with an iron content of about 97 Fe weight % minimum. The percentage carbon would be less than 1%, oxygen less than 0.6%, nitrogen less than 1%. The average particle diameter is 4–6 microns.

The Niculoy (Trademark) alloy has a nickel content of about 87%, copper content of about 5% and phosphorous content of about 12%.

Other components for the electroless bath include an activating agent known as Activator 1424 which is also a product of Shipley. Different bath components can be used depending on the required plate coating to be imparted to the particles. For instance, Siphley's Niposit 468 (Trademark) is a product which gives high solderability, conductivity and bondability. This product includes boron as a reducing agent. Other properties include a magnetic permeability, semi-bright finish and a higher melting point and hardness relative to a nickel-phosphorous plating bath.

In performing the plating procedure it is first necessary to determine the weight of iron powder per unit volume of plating solution. Thereafter, the plating bath is prepared. The coating thickness of the alloy is calculated on the basis of the nickel weight to be deposited on the iron powder during plating and assumes uniform distribution on each particle. Based on this, the plating solution is prepared and heated appropriately. An effective temperature for maintaining the plating bath has been found to be about 65° C..

The activator for the carbonyl iron is next prepared and the iron powder is activated by pouring the activator into the iron powder and mixing. After an appropriate time the iron powder is removed from the activator using a magnet and is transferred to a quenching and rinsing solution of deionized water so as to minimize dissolution of the iron powder in the activator solution. A second deionizing step may be necessary. The pH is then adjusted and the iron powder is transferred to the plating bath.

Experimentation has indicated that a period between 30 minutes and 45 minutes is preferred to impart an effective plating coat to the iron particles. When the plating process is complete, the coated powder is removed from the bath using a magnet and transferred to a tank of deionized water for rinsing. A stream of deionized water can be passed over the powder to assist rinsing. Thereafter the coated iron powder is transferred to a tray were it is spread evenly to facilitate drying at a temperature of 105° C. for at least two hours for each kilogram of material. The coated powder is then cooled to room temperature and classified using an appropriate sieve which may be between 200 mesh to 400 mesh. Storage can be effected in a suitable polypropylene container.

Primary tools to assess the degree of oxidation protection are thermogravimetric analyses (TGA), X-ray diffraction and atomic adsorption spectrophotometry (AAS).

The TGA technique of determining change in sample mass is an analytical method wherein mass loss or gain is determined as a function of temperature or time. By this method the degree of oxidation, as indicated by increasing mass can be determined as the temperature increases.

X-ray diffraction techniques employ the principals of electromagnetic wave diffraction using the spacing between adjacent planes of atoms and crystals as a diffraction grating. This provides information on the crystalline material produced by the diffraction.

TGA analyses were performed in moist air and the temperature was increased from 30° C. to 110° C. at a rate at 10° C. per minute. Resultant TGA scans were then evaluated as to the temperature corresponding to the onset of oxidation. Thermo-oxidation resistant powders have higher temperatures of oxidation onset.

By the invented procedure, powder of particle size of less than 20 microns is obtained which has the magnetic properties of iron with greater resistance to oxidization as provided by the nickel plating coat.

The amount of nickel deposited on the powder can be determined by AAS which indicates the amount of nickel depletion. The AAS results are compared with the TGA results and this permits for determination of the weight of nickel deposited.

Agglomeration of the particles during plating may be a problem and this can be overcome by the use of ultrasonic vibration to cause particle repulsion. Decreasing the rate of deposition, decreasing the bath temperature, or decreasing the nickel concentration can also alleviate this problem.

Annealing the plated powdered iron increases oxidation resistance and samples annealed for two hours at 450° C. in a vacuum show an increase in the oxidation initiation temperature to 625° C.. The oxidation resistance can be increased to temperatures up to about 800° C..

Two methods of plating have been found to be effective, namely immersion and autocatalytic plating.

Immersion plating is a replacement reaction in which surface atoms of a metal of high electrochemical oxidation potential are replaced by atoms of lower oxidation potential. Immersion plating is self limiting in that once the surface is completely covered by the deposit the reaction stops. Autocatalytic plating refers specifically to the deposition of metals by controlled and ordered catalytic chemical reduction. This basically two step process involves the electrochemical replacement between the surface iron atoms and the metal ions in solution. The surface coating that is formed then acts to catalyze the subsequent reduction plating process. The plating solution contains either a phosphite or boron reducing agent. This type of plating reaction is self sustaining and relatively thick coatings can be obtained.

A particular exemplary procedure is now described in detail:

Prior to plating bath preparation, the weight of iron powder per unit volume of plating solution to be used was determined. The coating thickness of nickel alloy was calculated on the basis of nickel weight deposited on the iron powder during plating, assuming uniform distribution of each particle. Thus with a plating bath volume of 95L and a bath capacity of 4.1g nickel available per liter of solution, the following table indicates the weight of iron to be added to achieve each of the listed coating thicknesses.

| Nominal Thickness, microns | Ni Wt, g | Fe Wt, g | Total CMP Wt, g |
|---|---|---|---|
| 0.2 | 389 | 1556 | 1945 |
| 0.3 | 389 | 952 | 1341 |
| 0.4 | 389 | 691 | 1080 |

95L of Niculoy 22 electroless nickel plating solution was prepared as follows:

50L of deionized water was added to a plating tank and a stirrer at medium speed (500 rpm) was started. 19L (5.0 gal) of Niculoy 22M was added to the plating tank. 3.1L (0.8 gal) Niculoy 22S was added to the plating tank, and 23L of deionized water was added or filled to the 95L mark on the plating tank.

A 1000 watt immersion heater and thermometer in the plating tank was adjusted to the highest setting. The tank was heated to 65° C. and maintained at that temperature.

5L of Activator 1424 was prepared in a fume hood: 50g of Activator 1424 was added to a 20L tank, and 3.5L of deionized water was added to the tank, and mixed until most of activator was dissolved. 50ml of concentrated hydrochloric acid was added and mixed until all the activator dissolved. The solution was allowed to return to room temperature.

The plating bath temperature at 65° C.±2° C. was confirmed prior to initiating the next step. The amount of iron powder as calculated was weighed in a 4L beaker. 2L of Activator 1424-iron powder mixture was added using a glass stirring rod for 2 minutes. At the end of 2 minutes the iron powder from the activator solution was transferred using a magnet into a 20L tank containing 10L of deionized water. This transfer and quenching was accomplished as rapidly as possible to minimize dissolution of the iron powder in the activator solution. The iron powder was removed using the magnet and transferred to a second 20L tank containing deionized water.

The pH of the second deionized water rinse was measured, and if the solution pH was less than 5.0, subsequent rinses were performed until this value was achieved. If the rinse soluion pH was greater than 5.0, the powder was ready to plate the plating bath temperature (65° C.±2° C.) was confirmed. The mixer speed was increased to a maximum rate achievable without causing splashing of plating solution. The iron powder was transferred to the plating bath, rinsing any powder remaining in the beaker with a stream of deionized water, preferably using less than a total of 2L deionized water to effect this transfer.

The iron powder was plated in the Niculoy 22 bath for a minimum of 30 minutes and a maximum of 45 minutes. When the plating process was complete, the coated powder was removed from the bath using the magnet, and transferred to a 20L tank containing 10L of deionized water.

The coated powder was rinsed in the 20L tank for 10 minutes with a stream of deionized water, allowing the excess water to overflow the tank into the drain. The remaining deionized water was decanted from the rinse tank. The coated iron powder was transferred to a glass tray, spreading the powder evenly to facilitate drying. The coated metal powder was dried in a forced air oven at 105° C.±3° C. for a minimum of 2 hours for each kilogram of material. When dry, the coated metal powder was cooled to room temperature. The powder was classified using a 325–400 mesh sieve and automatic shaker. All material that passed the sieve was retained and weighed.

The following table indicates comparative experimental results in relation to different processes condition. Selected data from the above table are then discussed. TGA analyses were preformed to determine the oxidation onset temperature.

TABLE 1

IRON PLATING EXPERIMENTS

| SAMPLE # | PLATING CONDITIONS | | | | | | ANALYSIS OXIDATION ONSET |
|---|---|---|---|---|---|---|---|
| | PLATING SOLUTION | VOLUME ml | TEMP °C. | TIME MIN. | TYPE | REMARKS | TEMP °C. |
| Fe | — | — | — | — | — | — | 200 |
| Ni | — | — | — | — | — | — | 425 |
| 80A | Ni—$NiCl_2$ + $H_3BO_4$ | 25 | 85 | 5 | Immersion | Not very reactive | 300 |
| 80B | Cu—$CuSO_4$ + $H_2SO_4$ | 25 | 25 | 0.5 | Immersion | Very reactive | 200 |
| 83A | Sn—$SnSO_4$ + $H_2SO_4$ | 50 | 90 | 10 | Immersion | Salts difficult to dissolve possibly no reaction | 275 |

TABLE 1-continued

IRON PLATING EXPERIMENTS

| SAMPLE # | PLATING CONDITIONS: PLATING SOLUTION | VOLUME ml | TEMP °C. | TIME MIN. | TYPE | REMARKS | ANALYSIS OXIDATION ONSET TEMP °C. |
|---|---|---|---|---|---|---|---|
| 83B | Au on #80B $AuCl_3$ + alcohol | 50 | 25 | 5 | Immersion | $AuCl_3$/alcohol and powder turned green | 300 |
| 84-1 | Au—$AuCl_3$ + alcohol | 50 | 25 | 4 | Immersion | Reaction slow. Solution turns green | 275 |
| 84-2 | Ni—Niposit 468 | 50 | 60–70 | 5 | Catalytic | Reaction appears to stop after 5 min. | 350 |
| 84-3 | Ni/Cu/P—Niculoy #22 | 50 | 90–97 | 7 | Catalytic | Very reactive, appears to stop after 7 min. | 400 |
| 85 | Ni/Cu/P—Niculoy #22 | 3 × 500 | 90 | 6,6,12 | Catalytic | Fe cleaned with 1424 plating vigorous | 400 |
| 86 | Ni—Niposit 468 | 3 × 500 | 82 | 6,6,12 | Catalytic | Fe cleaned with 1424 | 450 |
| 86-1 | — | — | — | — | — | Sample #86 heat treated 2 hrs @ 450° C. in Vacuum | 475 |
| 87 | Ni/Cu/P—Niculoy #22 | 500 | 89–95 | 6 | Catalytic | Fe cleaned with 1424 | 375 |
| 87-1 | — | — | — | — | — | Sample #87 heat treated 2 hrs @ 470° C. in Vacuum | 550 |
| 87-2 | — | — | — | — | — | Sample #87 heat treated 2 hrs @ 570° C. in Vacuum | 550 |
| 89 | Au on Sample #86 Au $Cl_3$ + alcohol | 100 | 25 | 60 | Immersion | — | 450 |
| 92 | Ni/Cu/P—Niculoy #22 | 1500 | 85 | 7 | Catalytic | Scale up of Exp. #87 Sample heat treated 1 hr @ 500° C. in vacuum | 550 |

SAMPLE 80B

The $CuSO_4$ plating solution was analyzed before and after plating for Cu and Fe by AAS. It was found that a 1.78 meq of Cu was removed from solution (i.e. plated out on the part) and 1.8 meq of Fe was dissolved. Since this is a replacement type reaction there is an approximate balance in the meq between Fe and Cu.

SAMPLES 85 and 87

These are both Niculoy #22 nickel/copper/phosphorous plates. Both plated samples were analyzed by AAS for iron, nickel, and copper absorption. Phosphorous was determined by difference. The results are summarized in the following table:

| Element | Sample Analysis % wt/wt #85 | #87 |
|---|---|---|
| Fe | 27.5 | 30.5 |
| Ni | 63.0 | 61.1 |
| Cu | 0.6 | 0.3 |
| P | 8.9 | 7.8 |

Both samples had almost identical weights of plated material even though Sample 85 was contacted with fresh plating solution four times larger than Sample 87. The reason for this could be found in the method of mixing, its speed and the mixing device. In Sample 85, this was a stirring bar, and in Sample 87, a high speed paddle.

An X-ray diffraction pattern obtained on Sample 85 as plated and after the TGA analysis indicated the material that the nickel/copper/phosphorous material plated on the powder had no crystal structure and is, therefore, amorphous. The X-ray diffraction scan taken of the oxidized material after the TGA showed a presence of $Fe_3O_4$, $NiOFe_2$ CuO and NiO and $Fe_2CuO_4$

SAMPLE 86

An X-ray diffraction scan of this material prior to TGA analysis showed the presence of Fe and Ni, and the nickel plate was crystalline. The X-ray diffraction scan obtained on the oxidized material after the TGA showed the residue to be $NiFe_2O_4$. An AAS analysis indicated the material yielded a 44.4% Fe and 56.1% Ni composition.

Fractions of Samples 86 and 87 were heat treated under vacuum. The TGA of Sample 86, heat treated nickel plated Fe, showed little change in oxidative protection. In contrast, the TGA of Sample 87, the heat treated Ni/Cu/P plated, Fe, showed a substantial, namely 200° C., increase in the oxidation onset temperature.

The plated powdered metal with the increased oxidation resistance can be used to construct articles and products having the properties of powdered metal and the increased benefit of raised oxidation resistance at elevated temperatures, while retaining the magnetic permeability of the iron prior to plating. The plating powder can be used to constitute a layering material for a substrate, imparting to that substrate the improved oxidation resistance characteristics.

The metal powder can be other than iron, for instance, it may be nickel, or cobalt or other Group VIII transition metals.

The multiple potential uses of the plated product are set out in the background. The temperature of increased resistance to oxidation is raised by several hundred degrees centigrade by this invention. Thus for iron, the temperature is increased from an onset temperature of 200° C. to greater than 400° C. and even up to 800° C..

It will be appreciated that many different embodiments and examples of the invention have been set out above. Clearly many variations are possible while remaining within the spirit and scope of the invention, which is defined in the following claims.

What is claimed is:

1. A fine powder comprising particles consisting essentially of carbonyl iron particles which are substantially uniformly spherical and plated with a metallic alloy coating, said coating being resistant to oxidation up to a temperature of at least about 400° C., said particles being of substantially separate integrity, having a particle size less than 10μ, and a magnetic permeability substantially unchanged relative to the magnetic permeability prior to plating.

2. A powder as claimed in claim 1 wherein the average particle diameter is about 5 microns.

3. A powder as claimed in claim 1 wherein the average particle diameter is between about 1 micron and about 10 microns, and preferably between about 3 microns and about 7 microns.

4. A powder as claimed in claim 3 wherein the coating substantially covers each particle.

5. A powder as claimed in claim 4 wherein the thickness is an average of about 0.3 microns.

6. A powder as claimed in claim 4 wherein the coating thickness is between about 0.1 micron and about 0.7 microns, and preferably between about 0.2 microns and about 0.4 microns.

7. A powder as claimed in claim 1 wherein the coating is resistant to oxidation at a temperature between 400° C. and 800° C..

8. A powder as claimed in claim 1 wherein the coating is resistant to oxidazation up to a temperature of at least 800° C..

9. A powder as claimed in claim 8 wherein the particle diameter is in a range between about 1 micron and about 10 microns.

10. A powder as claimed in claim 1 wherein the coating metal includes at least a nickel alloy.

11. A powder as claimed in claim 1 wherein the coating metal includes at least a copper alloy.

12. A powder as claimed in anyone of claims 1, 10, or 11 wherein the coating includes at least phosphorous.

13. A fine powder comprising particles consisting essentially of carbonyl iron particles which are substantially uniformly spherical and plated with a metallic alloy coating, said coating being resistant to oxidation up to a temperature of at least about 400° C., said particles being of substantially separate integrity, having a particle size less that 10μ, and a magnetic permeability substantially unchanged relative to the magnetic permeability prior to plating, wherein the coating is deposited in an electroless plating bath while subjecting the particles to ultrasonic vibration to cause particle repulsion so that the particles do not agglomerate.

14. A powder is claimed in claim 13 wherein the plating bath contains at least one of a nickel salt or a copper salt.

15. A powder as claimed in claim 10 wherein the plating bath solution contains selectively a phosphate or boron reducing agent.

16. A powder as claimed in claim 1 wherein the average particles diameter is between about 3 microns and about 7 microns, and the coating thickness is between about 0.2 microns and 0.4 microns.

17. A powder as claimed in claim 16 wherein the coating layer is resistant to oxidization at a temperature greater than about 400° C..

18. A powder as claimed in claim 17 wherein the coating is deposited in an electroless plating bath containing selectively at least one of a nickel salt or copper salt and selectively a phosphite or boron reducing agent while subjecting the particles to ultrasonic vibration to cause particle repulsion so that the particles do not agglomerate.

* * * * *